US007490882B2

(12) United States Patent
Nguyen et al.

(10) Patent No.: US 7,490,882 B2
(45) Date of Patent: Feb. 17, 2009

(54) CLAMPING DEVICE FOR LIFTING SLAB, PANEL OR SHEET MATERIAL

(75) Inventors: Hoa Nhon Nguyen, Sydney (AU); Hau Nhon Nguyen, Sydney (AU)

(73) Assignee: Abaco Machines (Australasia) Pty, Ltd, Fairfield, New South Wales (AU)

( * ) Notice: Subject to any disclaimer, the term of this patent is extended or adjusted under 35 U.S.C. 154(b) by 428 days.

(21) Appl. No.: 10/514,967

(22) PCT Filed: Jan. 14, 2003

(86) PCT No.: PCT/AU03/00032

§ 371 (c)(1),
(2), (4) Date: Nov. 18, 2004

(87) PCT Pub. No.: WO03/057613

PCT Pub. Date: Jul. 17, 2003

(65) Prior Publication Data

US 2006/0163892 A1 Jul. 27, 2006

(30) Foreign Application Priority Data

Jan. 14, 2002 (VN) ..... 2-2002-00004

(51) Int. Cl.
*B66C 1/48* (2006.01)

(52) U.S. Cl. ..... 294/102.1; 294/103.1; 294/901; 269/95

(58) Field of Classification Search ..... 294/103.1, 294/102.1, 16, 63.1, 119.1, 901; 254/393, 254/394, 395, 401; 269/95, 43, 143, 249; 24/254

See application file for complete search history.

(56) References Cited

U.S. PATENT DOCUMENTS

| | | | | |
|---|---|---|---|---|
| 1,272,359 | A * | 7/1918 | Bell | 294/103.1 |
| 1,279,359 | A * | 9/1918 | Bell | 102/489 |
| 5,893,595 | A * | 4/1999 | Corbett | 294/102.1 |
| 7,156,436 | B2 * | 1/2007 | Nguyen | 294/102.1 |
| 2006/0197350 | A1 | 9/2006 | Nguyen | |
| 2006/0202496 | A1 * | 9/2006 | Davis | 294/102.1 |

FOREIGN PATENT DOCUMENTS

| | | | |
|---|---|---|---|
| CA | 2500249 | A | 9/2006 |
| DE | 19923788 | A1 * | 12/2000 |

* cited by examiner

*Primary Examiner*—Paul T Chin
(74) *Attorney, Agent, or Firm*—Shewchuk IP Services, LLC; Jeffrey D. Shewchuk

(57) ABSTRACT

A clamping device suitable for lifting and handling of sheet like-objects has a fixed jaw parallel to a movable jaw. The movable jaw is supported for reciprocating, linear movement towards and away from the fixed jaw responsive to a tensile actuating force. The movable jaw comprises a clamping plate inclined at an angle of about 8 to 12 degrees with respect to first and second clamping surfaces. The clamping plate maintains said angle during movement to and from the fixed jaw. A tensile force transmitting member is guided and supported at an upper location of the clamping plate that substantially aligns with or overhangs the second clamping surface.

20 Claims, 7 Drawing Sheets

B 110
70
30
28
82
30
32
26
64
32
60
36a
20
62
77a
86
77
34
36
24
72
38
22
B
110
94
80

CLAMPING DEVICE FOR LIFTING SLAB, PANEL OR SHEET MATERIAL

CROSS-REFERENCE TO RELATED APPLICATION(S)

The present application is a national phase application under 35 U.S.C. § 371 of PCT/AU03/00032, filed Jan. 14, 2003, and claims priority under 35 U.S.C. § 119 from Viet Nam application number 2-2002-00004, filed Jan. 14, 2002.

FIELD OF THE INVENTION

The present invention relates to clamping devices that may find use in hoisting and handling heavy slab, panel or sheet materials such as stone, masonry, concrete, marble, metal and the like materials. Specifically, the invention relates to an improvement for lifting clamps of the type having a rigid frame having a fixed jaw plate that provides a first clamping surface, a movable jaw plate that provides a second clamping surface and which is supported at the frame for reciprocating movement towards and away from the fixed jaw plate, and an actuating mechanism to bias the movable jaw plate towards the fixed jaw plate whereby the respective clamping surfaces abut onto opposite faces of the sheet material and frictionally clamp same against displacement.

BACKGROUND OF THE INVENTION

Heavy slabs and sheets of material are usually stored and stacked upright standing or in slightly inclined orientation. Handling of this type of materials often entails use of lifting clamps that grip the sheet (hereinafter used generically to also encompass slabs and other planar objects) at its upper edge for hoisting. Consequently, it is convenient in the following description of known devices and the lifting device in accordance with the present invention to use reference terminology such as 'vertical', 'horizontal', 'upper', 'lower' and similar when describing operation and components of such clamping devices, bearing in mind that these devices may also be used in a 'horizontal' or other orientation, eg as a simple clamp or a haulage attachment. Thus, unless otherwise clear in the context, such reference terms are not to be interpreted as a limitation.

A lifting clamp of the type with which the present invention is concerned is known from U.S. Pat. No. 5,893,595 (Corbett). The lifting device includes a rigid frame comprising vertical, parallel spaced apart side plates, the upper ends of which are rigidly secured together by four tubular cross-members. The lower portion of one of the side plates is angled away in downward orientation from the other side plate, the latter providing a fixed clamping jaw of the device. A vertically extending plate is mounted for horizontal sliding movement on the cross-members between the side plates and provides a movable jaw of the device. An actuator carriage which is disposed for guided vertical up and down movement is located between the movable jaw and the lower, angled portion of the frame side plate, whereby a set of rollers of the carriage respectively engage the facing surfaces of the movable jaw plate and the angled portion of the frame side plate. The carriage is connected to a strip member that extends beyond the upper end of the frame and has a lifting lug to which is attachable a lifting cable or chain. In order to lift (or otherwise handle) sheet material, the device is placed over the upper edge of the sheet so that it is received between the fixed and movable jaw plates, the carriage is raised by lifting the strip member through pulling the lifting cable upwards, whereby the carriage travels on the angled frame side plate portion and displaces the movable jaw horizontally until it abuts on the facing surface of the sheet material. Upon increasing the upward pulling force, the sheet material is frictionally clamped sufficiently tightly for it to be lifted with the device. In essence, clamping of the sheet material between the plate jaws is achieved by wedging the carriage between the frame side plate and the movable jaw, and the clamping force is maintained for as long as there is upward force being on the lifting cable.

A lifting clamp of similar design to that of Corbett is disclosed in German patent publication DE 199 23 788 A1 (Scheibenbogen GmbH & Co KG), where, however, the mechanism employed to move the movable jaw into gripping engagement with the sheet material comprises a cam pulley instead of a wedging carriage. The pulley is mounted on the movable jaw plate with its axis of rotation perpendicular to the plane of the movable jaw plate, four rollers serving to support the pulley in parallel relationship at the facing jaw surface. Two cams are arranged on the opposite face of the pulley, concentrically with and symmetrical about the rotation axis. The cams extend equiradially over a sector of the of the pulley circumference. The height of the cams increase from near the pulley face to a maximum height that is dictated by the maximum spacing between the fixed and movable jaws of the clamp in their fully spaced apart position. The cams thus provide sloping guide and bearing surfaces for respective actuator rollers that are secured in fixed relationship on the frame plate of the device that faces the pulley. An actuator cable that is secured to the pulley perimeter is used to rotate the pulley, the actuator cable advantageously terminating in a hoop on which a hoisting cable or chain may be attached. In operation of the clamp, when a pulling force is exerted on the actuator cable, rotation of the pulley causes the actuator rollers to travel along the inclined (or curved) bearing surfaces of the cams, thereby displacing the movable jaw away from the facing frame plate towards the fixed jaw and clamping sheet material received between the jaws.

One disadvantage that has been observed with lifting clamps made in accordance with Corbett as well as Scheibenbogen is the tendency of the clamp frame, on lifting of in particular thin sheet material from the ground, of rotating into a different spatial attitude from the initially given "no load" attitude, the later being characterised by the substantially vertical orientation of the clamping surfaces of the jaws when these are clamped onto a sheet of material resting upright on the ground. This rotation induces swaying and swinging of the sheet material at the lifting cable that makes precise hoisting difficult, and increases breakage risk upon hitting against objects in the vicinity of the sheet. The moment that causes this rotation is induced by the presence of an out-of-alignment force pair on initial lifting off of the sheet attached to the clamp frame (upward directed lifting force vs downward directed weight of sheet material and clamp). This movement inducing moment decreases and ceases as the clamp frame and the sheet material rotate into and eventually assume a final, slightly inclined orientation with respect to the vertical, as the respective centres of gravity of the clamp and the sheet material seek to and ultimately align themselves along the same (vertical) line along which the lifting force is being exerted.

This problem stems from the lay-out of the clamp as such, ie due to the presence of a fixed clamp against which a single movable clamping jaw plate is forced. With such lay out, the line along which gravity force acts on the upright sheet material locates within the clamp frame at different traverse locations, depending on the thickness of the sheet, and does not align with the point at which the upward directed hoisting force acts on the clamp frame, notwithstanding the lifting force ultimately acts on the carriage or cam pulley of the clamp actuating mechanism in close vicinity of the secured sheet material.

Equally, whilst the cam pulley clamping mechanism of Scheibenbogen has the advantage over Corbett's of providing a more even distribution of clamping pressure onto the sheet material, the Scheibenbogen lifting clamp has a more pronounced tendency of swaying under load, which results in difficulties in controlling movement of sheet material during transport.

One object of the present invention is to provide a lifting device of the aforementioned type in which the tendency of the clamp of swaying into an inclined position during lifting of sheet material is minimised.

SUMMARY OF THE INVENTION

In accordance with one aspect of the invention there is provided a clamping device suitable for lifting and handling of sheet like-objects, having a rigid frame with a fixed jaw that provides a first clamping surface, a movable jaw that provides a second clamping surface that is substantially parallel to the first clamping surface, the movable jaw being supported at the frame for reciprocating, linear movement towards and away from the fixed jaw, and an operating mechanism arranged to bias the movable jaw towards the fixed jaw in response to an actuating force being exerted on a tensile force transmitting member of the operating mechanism, thereby to abut the respective clamping surfaces onto opposite faces of an object received between the jaws and frictionally clamping same against displacement, characterised in that the movable jaw comprises a sliding plate on which the second clamping surface is provided, the sliding plate being inclined at an angle of about 8 to 12 degrees with respect to the first and second clamping surfaces and being supported at the frame to maintain said angle during movement to and from the fixed jaw, and in that the tensile force transmitting member is guided and supported at an upper location of the sliding plate that substantially aligns with or overhangs the second clamping surface.

It has been found that the inclined arrangement of the sliding plate and location of the force transmitting member reaction point at the sliding plate have positive effects in minimising the presence of swing-inducing moments when a slab or sheet material of relatively small thickness is hoisted with the clamp, as the reaction point of the lifting force at the sliding plate is brought in closer alignment with the line along which gravity exerts force on the sheet material. An inclination angle of the sliding plate of about 11 degrees renders particularly good results in minimising the gravity and lifting force induced moment at the clamp frame, providing thus better lift/hoisting control.

Advantageously, the operating mechanism of the lifting clamp comprises a cam pulley system whose operating principle (but not necessarily its constructional layout) is similar to the one described in above mentioned German document, the contents of which is incorporated herein by way of cross-reference. Such actuating system provides for a more uniform and even clamping load distribution as compared to the solution of Corbett.

Accordingly, in accordance with a preferred implementation of the invention, the operating mechanism includes a drive pulley that is mounted on the sliding plate of the movable jaw with its axis of rotation perpendicular to the plate plane, a plurality (preferably four or more) of bearing rollers arranged to support the pulley in parallel relationship at the facing sliding plate surface, at least one, preferably two actuating cams protruding from the pulley surface that faces away from the sliding plate, the actuating cams being symmetrically disposed about the rotation axis of the pulley and extending along an arc sector radially inwards of the pulley circumference, the cams having a height that increases from near the pulley face to a maximum height that is related to the maximum spacing between the fixed and movable jaws of the clamp in their fully spaced apart position, the cams each defining a sloped guide and bearing surface for respective actuator rollers that are secured in fixed relationship on a stationary part of the clamp frame that faces the pulley, the arrangement being such that upon rotation of the pulley, the actuator rollers travel along the guide and bearing surfaces of the cams thereby displacing the pulley and therewith associated sliding plate along the axis of rotation of the pulley relative to the stationary clamp frame part.

The tensile force transmitting member used to rotate the pulley is preferably an actuator cable that is suitably secured to the pulley perimeter and partially wound on and running in a peripheral groove of the pulley. The actuator cable may advantageously terminate at its other, free end in a hoop on which a hoisting cable or chain may be attached.

In operation of the clamp, when a pulling force is exerted on the actuator cable, eg when hoisting a slab, rotation of the pulley causes the actuator rollers to travel along the bearing surfaces of the cams. The height increase of the cams can be constant, progressive or decreasing, ie the contour of the bearing surfaces can be rectilinear, curved or otherwise shaped, thereby to achieve a desired displacement movement of the sliding plate away from the stationary frame part, eg a frame plate, towards the fixed jaw. The sheet material received between the jaws is thus clamped with a force that is a function of the pulley diameter, the distance of the arc-shaped cams from the axis of rotation of the pulley, and the weight of the material being hoisted with the clamp.

When employing such cam pulley operating mechanism, the rigid frame may preferably be an assembly consisting of a side plate that provides the fixed jaw, a substantially rectangular parallelepiped shaped housing part with an open side disposed to face the side plate, whereby a bottom wall or side walls of the housing may provide the stationary frame part that supports and locates the actuating rollers that engage the cam pulley, and a plurality of (preferably four) cross struts rigidly joining the side plate and the housing part in spaced apart relation ship at upper ends thereof, the housing part having a cavity in which the cam pulley of the operating mechanism locates when the clamp is in a fully open state, eg non-clamping state, in which the movable sliding plate comes to rest adjacent the housing part and covers the open side face. The partially encased operating mechanism is thus protected from damage to its moving parts.

In a further preferred embodiment, the clamping device may incorporate a locking mechanism that is arranged to lock the cam pulley against rotation. The locking mechanism may be designed to be engageable only when the movable jaw is in its non-clamping position, or in any position.

One embodiment of the locking mechanism includes a rotatable locking plate attached to or otherwise operably connected to a handle, knob or other manual actuating member, the locking plate being supported at the housing part in a location where it can be rotated or displaced in and out of engagement with a locking receptacle provided either on the cam pulley or a support shaft thereof. A spring-loaded actuator rod that acts on the latch mechanism, located at the housing part front or side wall, is preferred.

A preferred embodiment of a clamping device as used for lifting slab materials in accordance with the present invention, and further features and advantages of the invention, will be described with the accompanying drawing.

BRIEF DESCRIPTION OF THE DRAWINGS

FIG. 1*a* is a side view of a lifting clamp in accordance with a first embodiment of the invention, its gripping position with a sheet material suspended there from;

DESCRIPTION OF PREFERRED EMBODIMENT

Figure 1B:
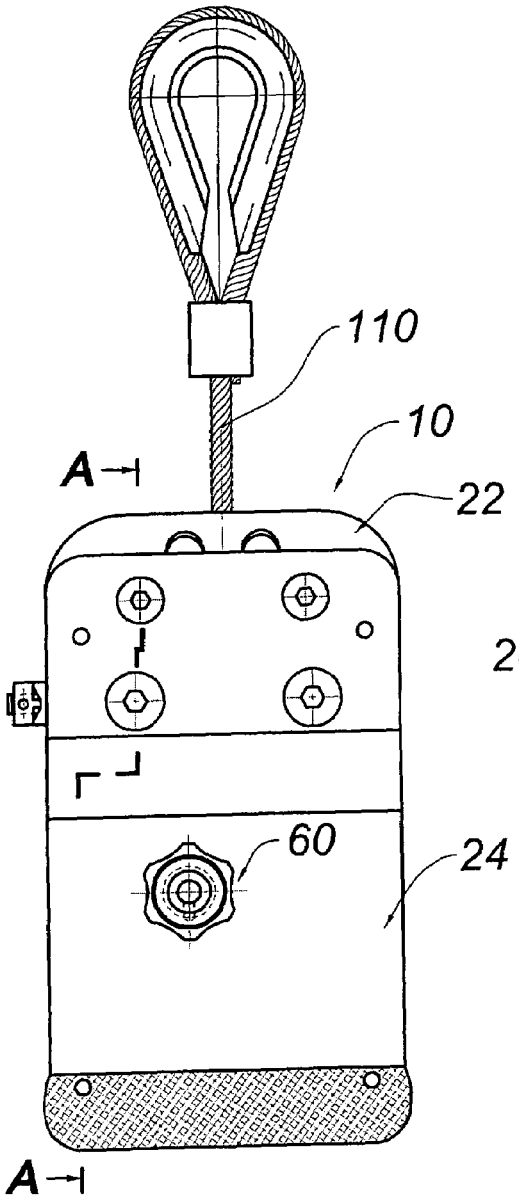
FIG. 1*b* is a front elevation of the clamp of FIG. 1*a;*

In the following description, reference terms such as 'upper', 'lower', 'vertical', 'horizontal', 'left' and 'right' are chosen with regard to the drawing plane of the relevant figures and to aid in referencing clamp components with respect to one another.

Figure 1A:
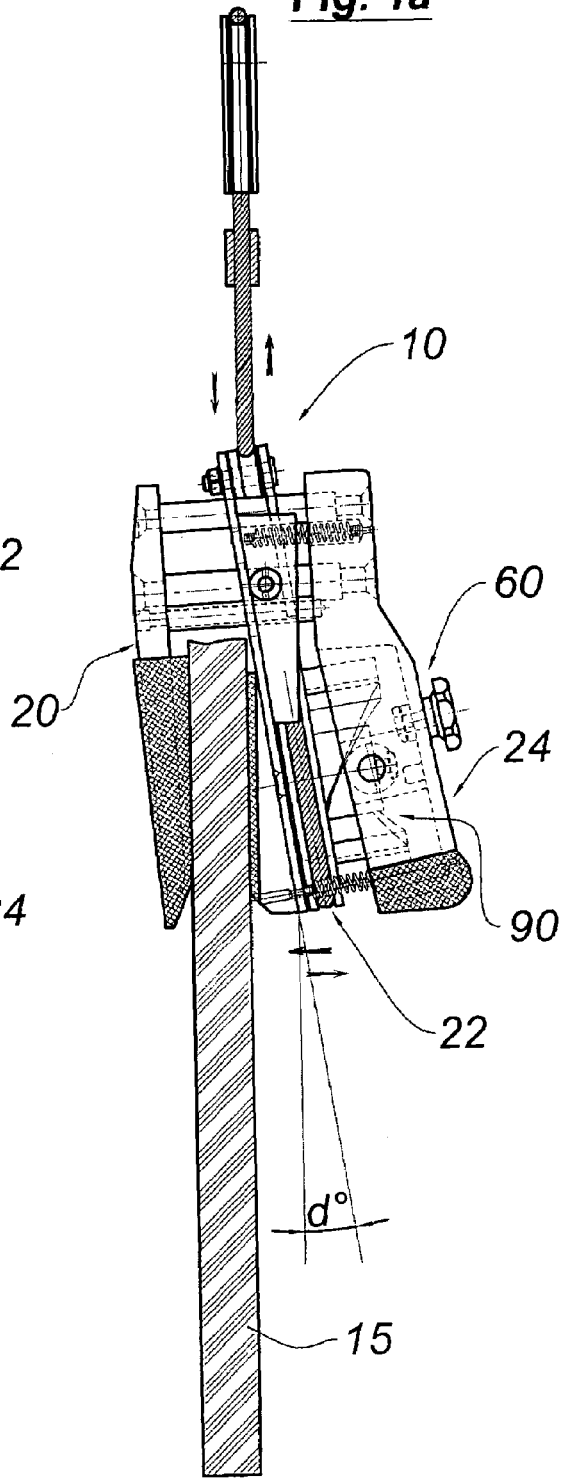

FIG. 1*a* illustrates a clamping device 10 in accordance with the present invention as used for lifting and hoisting sheet-like materials 15 of substantial dimensions and weight. The expression "sheet materials" is here generically also used herein to describe slabs of stone, marble, sheet or sheets of metal tightly bundled into a stack, or the like.

The lifting clamp 10 illustrated in greater detail in FIGS. 1*b* to 3 comprises substantially three subassemblies or groups, a fixed, stationary jaw section 20, a movable jaw section 22 and a stationary housing section 24, wherein an actuating mechanism 90 employed to move the movable jaw section 22 with respect to the fixed jaw section and housing section 24 is located between the housing and movable jaw sections.

Jaw section 20 and housing section 24 define a rigid clamp frame and are joined together at an upper end in spaced apart relationship by means of 4 cross bars 26 and 28, the terminal ends of which are fixedly secured to the respective sections 20 and 24 by appropriate screws 30, 32, see below. The upper pair of cross bars 28 also serve to suspend in guided manner the movable jaw section 22 so that it may be caused to slide there along upon actuation of the operating and clamping mechanism described below toward and away from the stationary jaw section 20 of the device.

Figure 2:
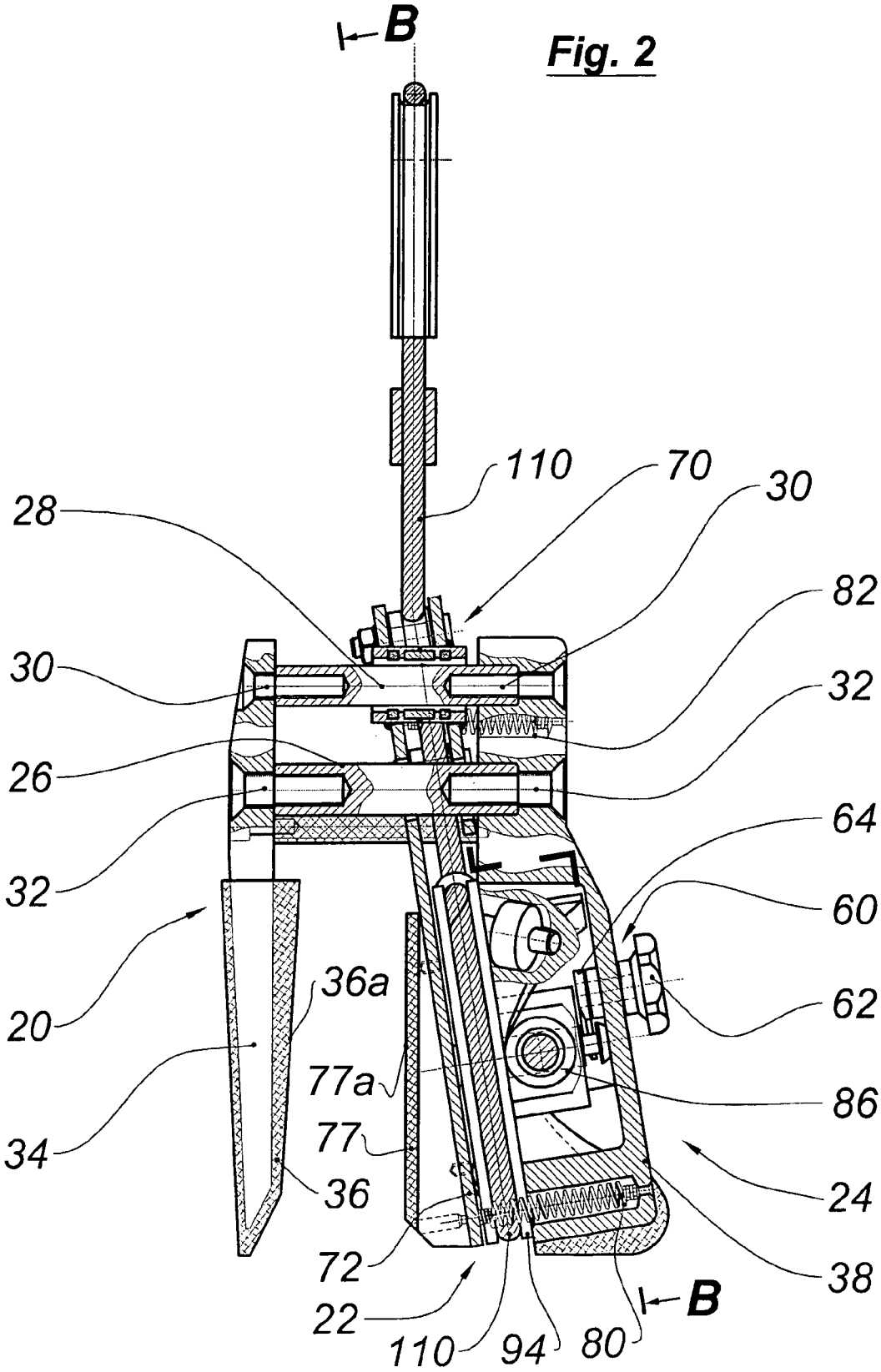
FIG. 2 is a longitudinal section of the clamp along line A-A of FIG. 1*b;*

Stationary jaw section 20 is comprised of a substantially rectangular steel plate member 34, having four bores disposed on an upper section to receive and secure the screws for fixing the cross bars 26, 28 to it. A rubber glove 36 is fitted to the lower portion of steel plate member 34. As shown in FIG. 2, the rubber glove 36 has a trapezoidal cross-section with a lower portion that is angled slightly inwardly to allow for easy manoeuvring of the jaw 20 onto the work piece or slab and into gripping position for lifting. Glove 36 provides a high friction material between the stationary jaw and the slab being lifted to prevent the slab from slipping or being damaged during lifting operation.

Figure 3:
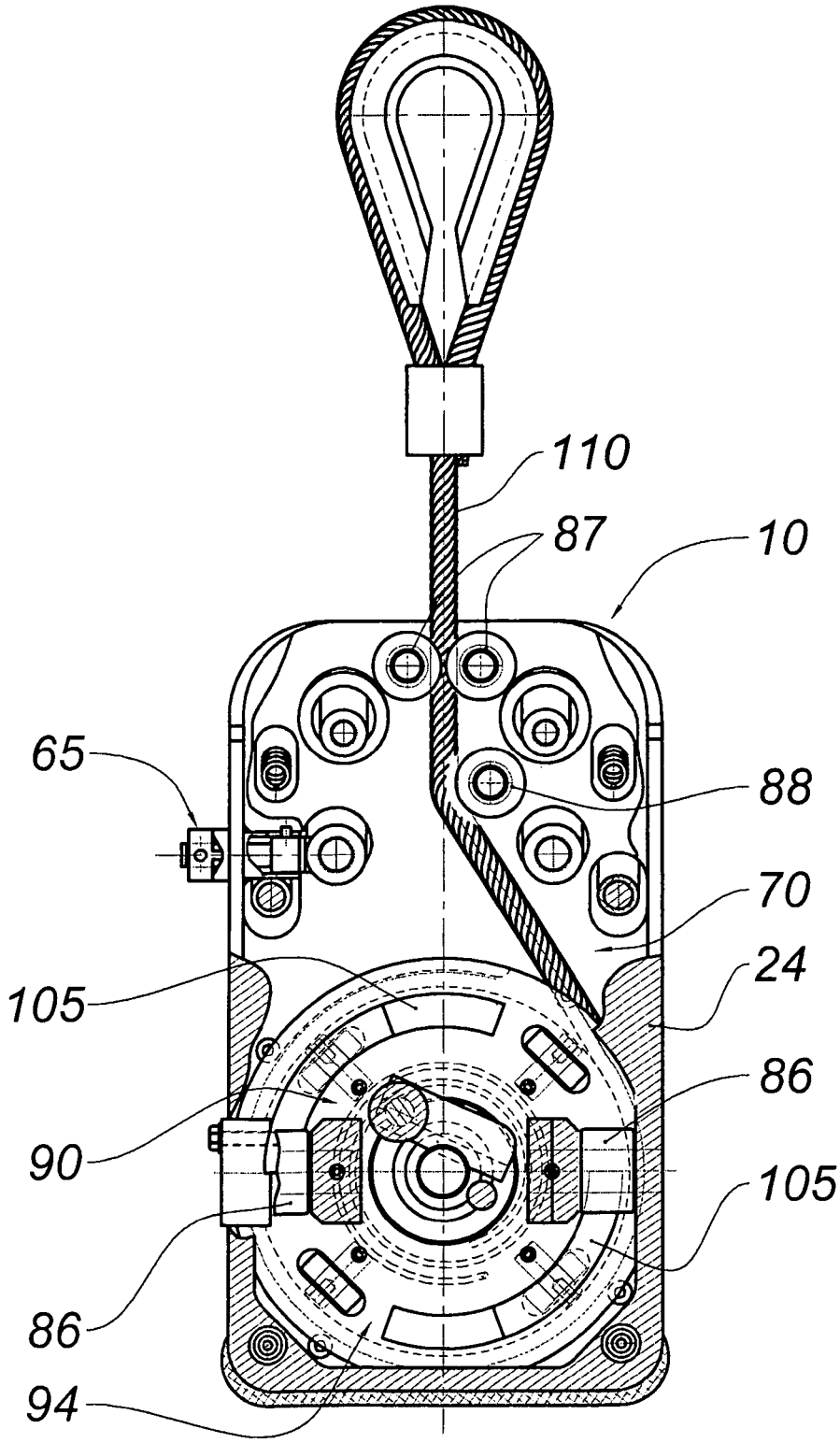
FIG. 3 is a plan section of the clamp taken along line B-B of FIG. 2.
Figure 4A:
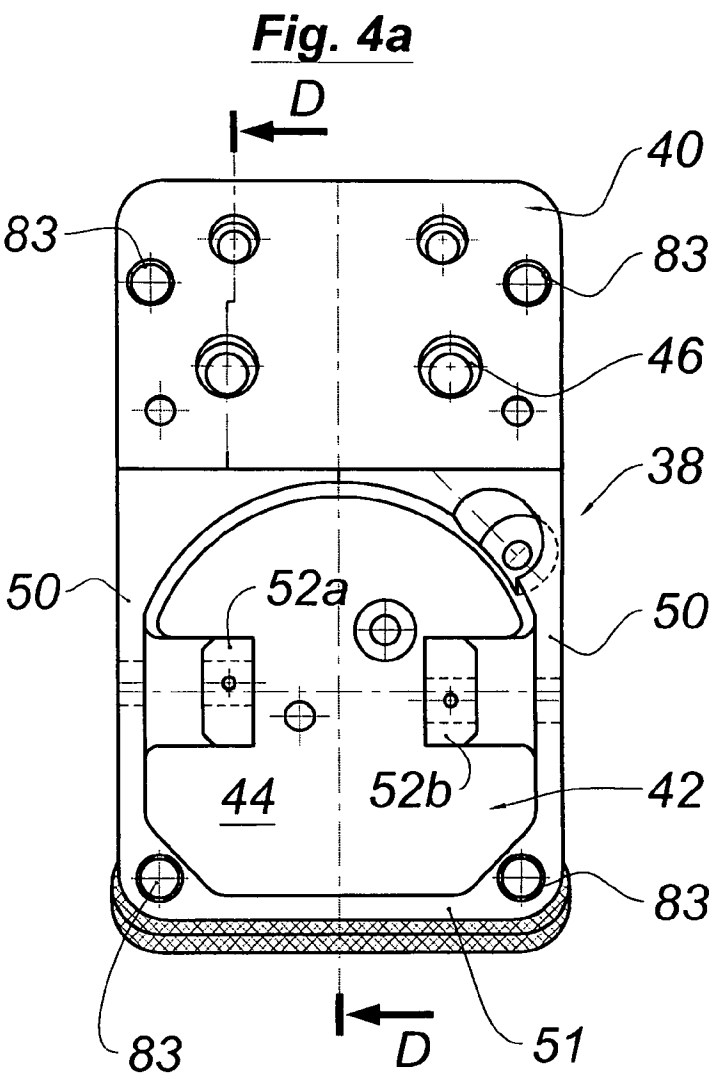
FIGS. 4*a* to 4*c* are, respectively, a front elevation, a side view and a section along line D-D of a housing part of the clamp that provides a stationary clamp part and protective cover for the operating and clamping mechanism of the clamp device of FIG. 1*a;*
Figure 4B:
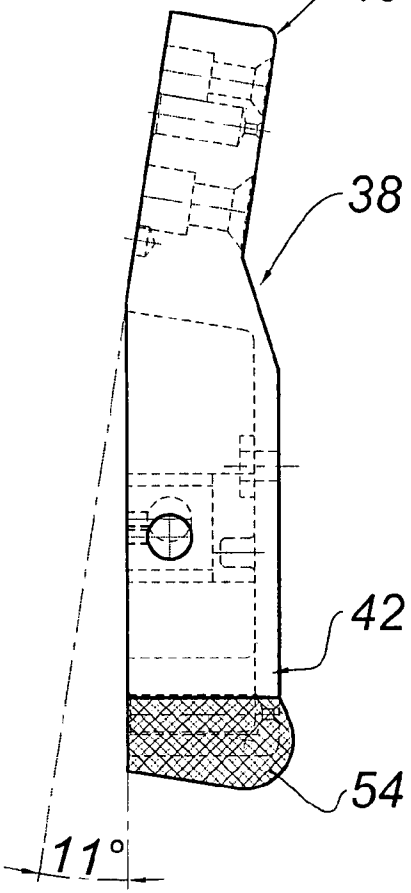
Figure 4C:
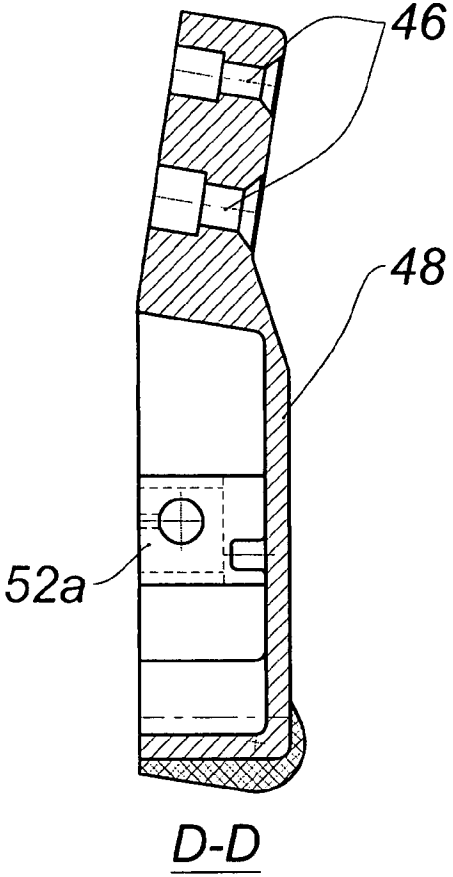

As best seen in FIGS. 4*a* to 4*c,* housing section 24 includes a substantially rectangular parallelepiped shaped housing box 38, that has a solid material upper portion 40 that is angled in side view about 9 to 12, preferably 11 degrees with respect to a lower housing portion 42. Upper portion has formed therein four bores of stepped diameter that serve to form-fittingly receive the terminal ends of cross rods 26 and 28 and secure same against displacement therein using screws 30, 32 (FIG. 2). Lower portion 42 includes an open cavity 44 bordered by opposing side walls 50, a bottom wall 51, a base wall 48 and said upper solid material portion 40. Within cavity 40 are arranged two diametrically opposing bearing pedestals 52*a* and 52*b* that are made integral with the respective side walls 50 and the base wall 48 and protrude therefrom into the cavity 40. Pedestals 52*a* and 52*b* serve to respectively support an actuator roller 86 (see FIGS. 2 and 3) of the operating mechanism for the movable jaw 22 (described below). Not illustrated in greater detail, actuating rollers 86 are supported on respective shafts that extend substantially parallel to base wall 42, the shafts being secured in known manner to the pedestals. Cavity 44 in lower housing portion 42 is dimensioned such as to cover and receive therein a cam pulley 94 of the operating mechanism 90 described below. A protective rubber shoe 54 covers the lower terminal end of housing box 38.

As can be best gleaned from FIGS. 1*a* and 2, housing section 24 also carries the components of a locking or arresting mechanism 65 employed to lock the movable jaw section 22 of the clamp against axial displacement along cross rods 28, whilst an additional arresting mechanism 60, described in greater detail below, serves to lock the actuating mechanism 90.

Figure 5B:
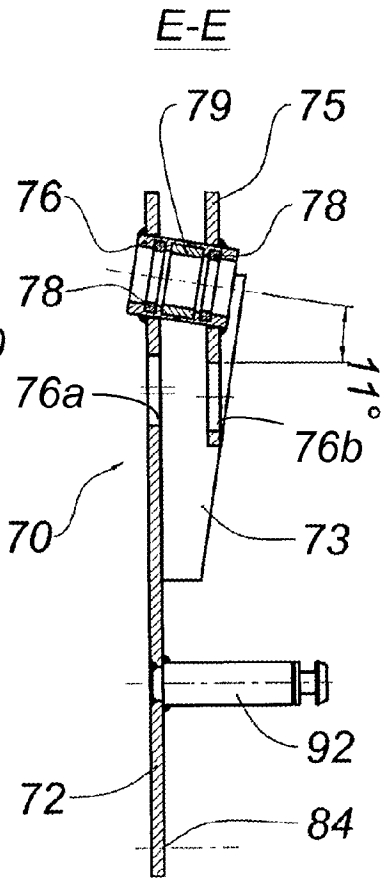
FIGS. 5*a* to 5*c* are, respectively, a front elevation, a side section along line E-E and a side view of a sliding plate that forms part of a movable jaw member of the clamp device of FIG. 1*a;*
Figure 5A:
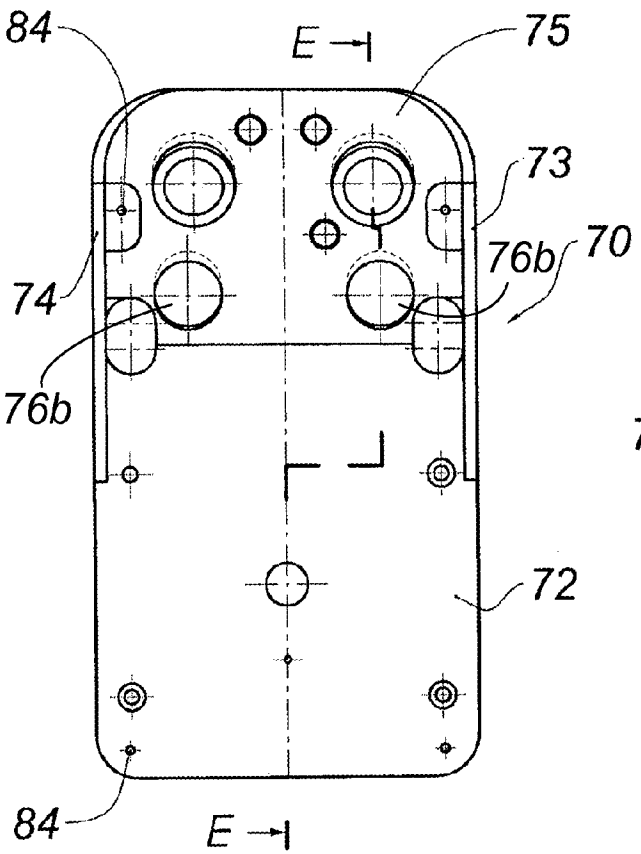
Figure 5C:
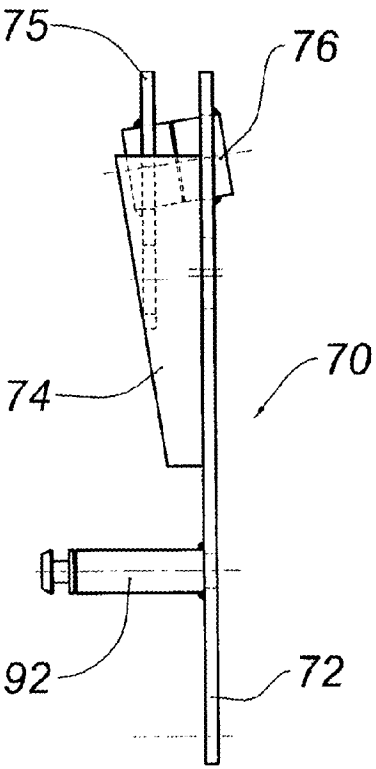
Figure 6:
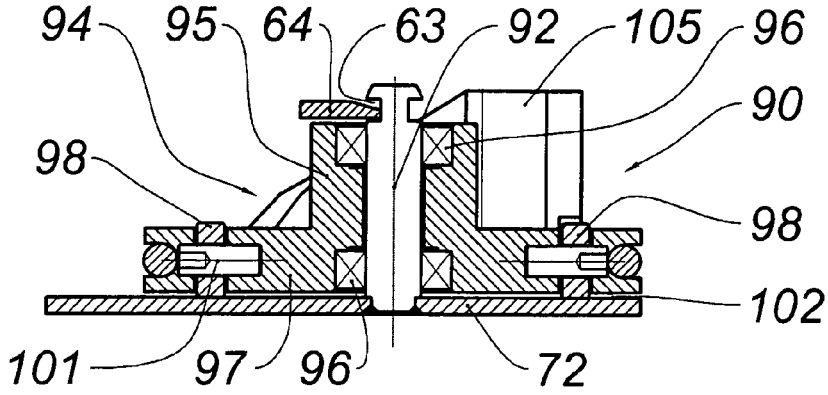
FIG. 6 shows in cross-section a partial view of the cam pulley of the operating and clamping mechanism for actuating the movable jaw of the clamp device.
Figure 7A:
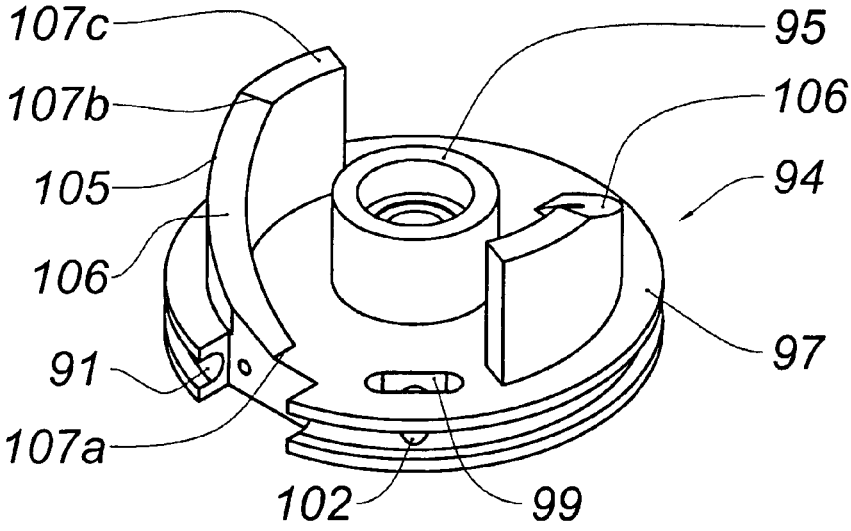
FIGS. 7*a* and 7*b* are an isometric top and bottom view of the cam pulley of the operating and clamping mechanism of the clamp device.
Figure 7B:
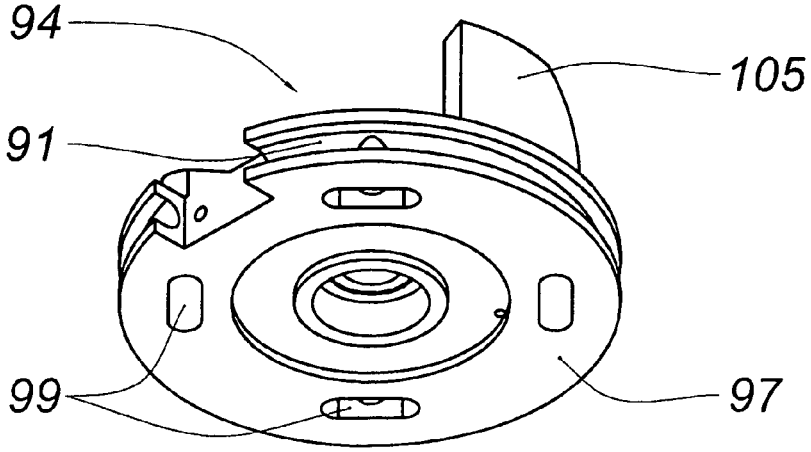

Turning next to FIG. 2 and 5*a* to 5*c*, the movable jaw section 22 comprises a sliding plate (assembly) 70 that includes a generally rectangular base plate 72 to which are welded at the upper width-wise edges thereof two side plates 73, 74 that extend perpendicular to base plate 72. Parallel to the latter and received between side plates 73, 74 is welded a smaller face plate 75. Guide tubes 76 that extend parallel to one another are received in openings in the face and base plates 72, 75 and welded to the plates. Ring seals 78 and a guide bush 79 are secured within the guide tubes as illustrated in FIG. 5*b*.

Guide tubes 76 serve the purpose of guiding and suspending the sliding plate assembly 70 in a defined orientation at the upper pair of cross rods 28 that extend between fixed jaw section 20 and housing section 24, that is with the plate assembly 70 maintaining an inclined attitude with respect to a vertical line as shown in FIGS. 1*a* and 2 whilst it displaces along the horizontally orientated cross rods (bars) 28. This angle is preferably set to about 11 degrees. Heretofore, the tubes 78 are welded to the base plate 72 with their longitudinal axis inclined about 11 degrees with respect to a line that extends orthogonally with respect to the plate's plane. As can be further seen from FIGS. 5*a* and 5*b,* an additional pair of openings 76*a* and 76*b* is respectively provided in face and base plates 72 and 75 below the guide tubes 76 thereby to allow the lower pair of cross rods 26 to pass extend through the sliding plate assembly 70 with play, as seen in FIG. 2.

As best is also seen in FIG. 2, a clamping plate 77, which in longitudinal section is about triangular, is mounted in fixed manner to the lower portion of base plate 72 of sliding plate assembly 70. The clamp plate 77 is rubber coated and defines the clamping surface of the movable jaw section 22, wherein the inclination angle at the pointed upper end of clamping plate is about 11 degrees, such that the inclination angle maintained between guide tubes 76 and base plate 72 is offset and the clamping surface 77*a* of clamp plate 77 is held about parallel to the clamping surface 36*a* provided at the fixed jaw plate 34; this parallel relation ship being maintained as the sliding plate assembly 70 moves along cross rods 28 of the clamp device 10.

As best seen in FIGS. 1*a* and 2, a set of tension springs 80, 82 is located between the movable jaw section 22 and the housing section 24 such as to bias the sliding plate assembly 70 towards the housing box portion 42 and cover cavity 44. This position represents the fully open clamp jaws position, and depending on the spring constants of the tension springs employed, see below, an additional locking member may be required to secure the open position. For symmetry reasons, four tension springs are used, located and secured in appropriate and known manner at the respective retention elements 84 at the corners of sliding base plate 72 (see FIG. 5*a*) and receptacle bores 83 in the housing part/section 38 (see FIG. 4). It is noted that the number of springs, the type of springs and the spring constants of the springs used to pull the movable jaw into the open position varies depending on several design parameters set for the lifting devices such as its size and weight, etc.

The sliding plate assembly 70 also carries at its lower portion a mounting axle 92 for a cam pulley 94 of the operating mechanism 90 of the clamp device, as will now be described with reference to FIGS. 2, 3, 6 and 7 in particular.

Mounting axle (or shaft) 92 is welded onto the side of base plate 72 that faces away from the fixed jaw section 20, and supports in axially fixed manner a cam pulley 94 for rotation. Cam pulley 94 has a disc portion 97 with a peripheral groove 91, a lower circular face that is held with small clearance parallel to the facing surface of base plate 72 and a protruding hub portion 95 on the opposite face housing a pair of thrust bearings 96 that serve to support pulley 94 at shaft 92 and react forces in axial direction of the shaft. As the cam pulley 94 may be subjected to quite considerable loads acting in shaft direction (ie perpendicular to the extension of the pulley disc portion 97) during clamping operation, a set of four, additional bearing wheels or rollers 98 are provided to maintain the clearance gap, reduce frictional load on the shaft bearings 96 and more evenly distribute loads past the pulley 94 onto the adjoining sliding plate assembly 70. Each roller 98 is received in a respective one of four housing openings 99 that extend through the disc portion 97 and which are located equidistantly spaced apart and with equal radius about the axis of rotation represented by the pulley shaft 92. Rollers 98 are supported at the disc portion 97 via respective axles 101 that are press-fitted or treaded into respective radially extending sack bores 102 whose axis extend radially away from and perpendicular to the pulley's axis of rotation, such that the outer surfaces of the rollers are in rolling contact with the facing surface of base plate 72 of the sliding plate assembly 70.

Cam pulley 90 includes, on the face spotting the hub portion 95, two identical cam members 105 symmetrically located about the axis of rotation of the pulley. In plan view (as per FIG. 3) cam members 105 have a curved or arcuate shape and are equiradially and concentrically spaced from the rotation axis of the pulley. Each of the two curved cam members 105 extends along an arc of at least 90 degrees and defines a sloped guiding surface 106 (see FIG. 7*a*) on its free terminal ridge. In other words, each guiding cam surface 106 increases in height from its lowest point at 107*a*, where it is at the level with the top surface of pulley disc portion 97, to a highest point at 107*b*, where it is farthest from the surface of the pulley disc, a planar end portion 107*c* of constant height adjoining the highest point.

The slope direction of the guide surface 106, ie in clockwise or anti-clockwise direction, at the cams will be dictated by the rotational direction in which the pulley disc is rotated by an operating cable 110 received in the pulley's groove 91 in order to displace the movable jaw section 22, ie whether the actuating cable unwinds clock or anticlockwise. In the embodiment shown in FIG. 3, cable 110 is wound to cause anti-clockwise rotation of pulley 94 upon cable 110 being pulled upwards.

As shown in FIG. 3, the upper portion of the base plate 72 of sliding plate assembly 70 carries a pair of guide rollers 87 in between which actuating cable 110 is guided at the upper end of the assembly 70 so that the cable extends therefrom in a line that coincides with the axis of rotation of cam pulley 94 and avoids an unsymmetrical loading of the clamp assembly 10 when hoisted (suspended). A deflection roller 88 is located below guide rollers 87, the centre of rotation of deflection roller 88 is vertically aligned with the right upper roller 87 because, in this embodiment, the cam rotates counterclockwise when force is exerted upwardly on cable 110 in order displace the movable jaw into its clamping position. The upper portion of cable 110 is formed into a loop such that the clamp device 10 can be hooked and lifted by a lifting crane or the like (not shown) during lifting operation. The other (lower) terminal end of actuating cable 110 is removably secured to the perimeter of cam pulley 74 at a recess using known fastening techniques.

As noted above, the operating mechanism 90 includes the actuating rollers 86 that are mounted in fixed locations in cavity 44 of stationary housing part 38. The location of these rollers 86 is such that these bear on and can travel along the bearing and guiding surface 106 of the respectively associated one of the cams 105, wherein the arrangement is such that rotation of the pulley 74 causes axial displacement of the sliding plate assembly 70 (with the attached cam pulley 74) along the upper guide cross bars 28 of the clamp frame and coaxial with the axis of rotation of the pulley. It can be seen from the arrangement of the pulley-cam mechanism that the length and the sloping angle of the cam surface 106 maybe chosen as desired, depending on the space or gap between the gripping surfaces 36*a* and 77*a* of the fixed jaw and the movable jaw, and thus the distance the movable jaw travels from its open position toward the fixed jaw in order to clamp the thinnest slab the device is designed to grip. It should be noted also that in its closed position for gripping the thinnest slab the device is designed to lift, the actuating rollers 86 must not contact the cam surfaces at their highest point 107*b*.

Another important point to note is that because the entire clamp device 10 is lifted using the same tensile force transmitting member that is used to cause the movable jaw assembly 22 to be displaced into a sheet material clamping engagement towards the fixed jaw assembly 20, a locking mechanism 60 is provided which when activated prevents the cam pulley 74 from being rotated and consequently keeps the jaw members 20, 22 in a fixed relation to one another. The locking mechanism 60 illustrated in FIGS. 2 and partly in 6, is designed to maintain the movable jaw section 22 adjacent the housing section 24 irrespective of whether the tension springs 80, 82 intended to bias the movable clamp section 22 into the open position are weak or strong, and irrespective of an actuating force being exerted on the actuating cable 110 that would otherwise cause the cam pulley 74 to rotate.

The locking mechanism 60 includes a locking bar 64 that is excentrically fixed to the terminal end of the shaft of a knob 62 that extends through and is secured in axially fixed but rotation permitting manner at the bottom wall 48 of housing part 38. Locking bar 64 is disposed to co-operate with a notched slot or groove 63 provided at the terminal free end of cam pulley support shaft 92. The shaft 92 must hereby be long enough to allow locking bar 64 to engage slot or groove 63 of the support shaft when the movable jaw section 22 is in the fully open position. When locking bar 64 is engaged in slot 64, the movable jaw section 22 is held stationary relative to the housing section 24.

Figure 8:
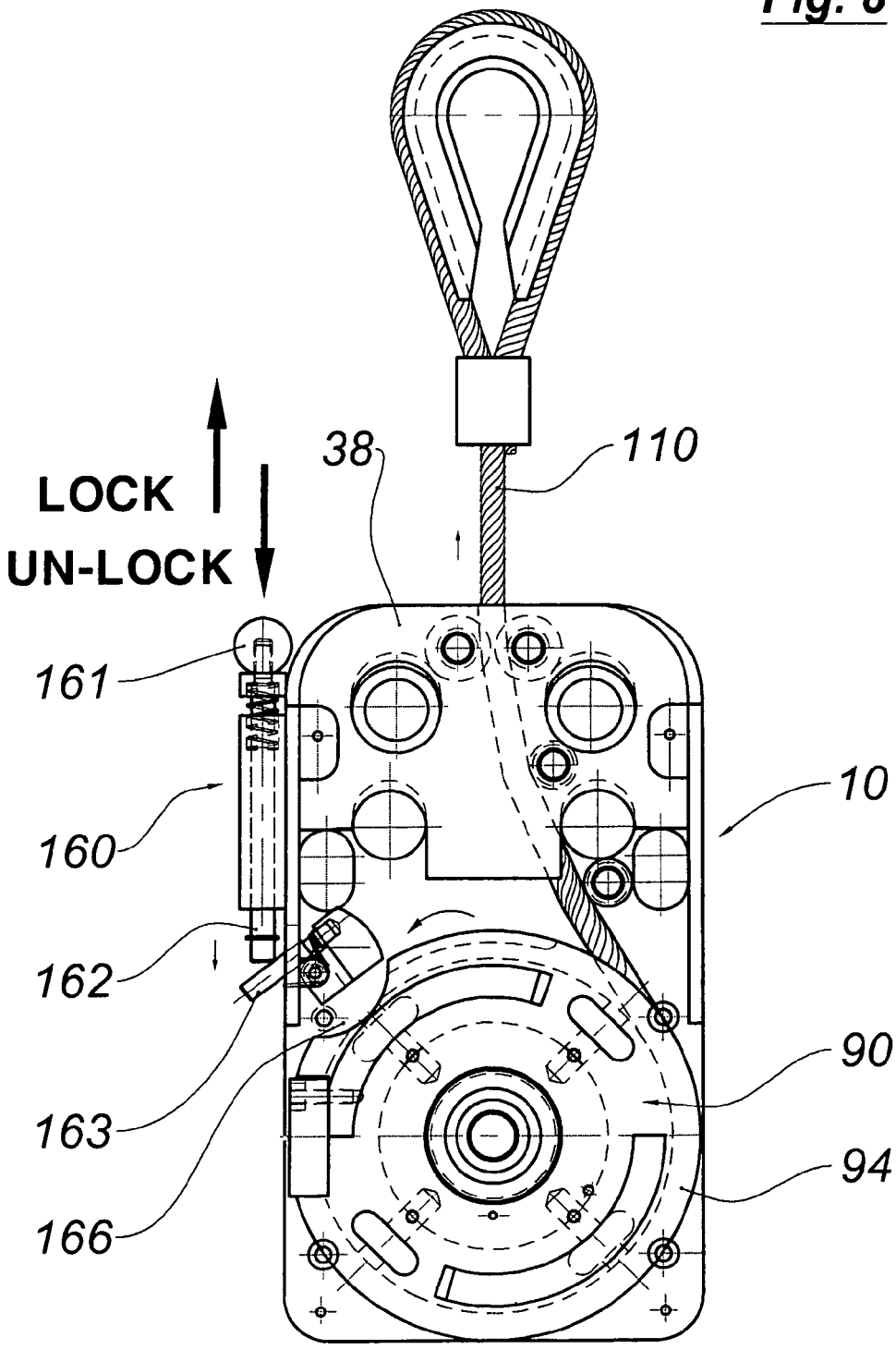
FIG. 8 is a plan section similar to FIG. 3 of the clamp device incorporating a second embodiment of a cam pulley locking device in accordance with an aspect of the present invention.

An alternative locking mechanism 160 is illustrated in the clamp device embodiment of FIG. 8, the clamp device otherwise remaining unchanged. The manual actuating member 161 includes a spring-loaded actuator rod 162 attached outside to the housing part 38. A latching plate 164 is fixed within the housing part cavity. 44 for rotation about an axis parallel to the rotation axis of the cam pulley 74. An actuator arm 163 is secured rigidly to latching plate 164 and extends through an opening in the housing part 38 into engagement with the terminal end of actuator rod 162. The cam pulley 74 has a cut-out 166 formed in its periphery into which the latching plate may be rotated into form-locking engagement to prevent rotation of the pulley 74.

Operation of the clamp device will now be described. As noted above, the entire device 10 may be hoisted through actuating cable 110 being secured to a hoisting cable. Normally, a lifting force exerted on cable 110 will cause cam pulley 74 to rotate and force the movable sliding plate assembly 70 which carries clamping plate 77 at its lower end to move toward the fixed jaw section 20 and thus close the clamp's jaws. Depending on the type of bias springs 80, 82 used, the movable jaw assembly 22 plate will or will not move when "normal" lifting force is initially exerted on cable 110: If springs 80, 82 are relatively weak, then the cam pulley 74 of operating mechanism 90 will rotate and drive the movable jaw toward the fixed jaw. If relatively stiff (high spring constant) springs are employed, the gravity force exerted by device 10 on the cable 110 by itself will not be sufficient to overcome the bias force of the springs when the device 10 is lifted. As such, the pulley-cam mechanism 90 will not move and the movable jaw 22 will remain open and stationary until an actuating force is exerted that is greater than the weight of the device as a whole. This additional force element can be exerted by an operator pulling the clamping frame downwards over the slab to be lifted When operating the clamp device with activated locking mechanism 60, regardless of spring type employed, the locking bar or plate must be disengaged from engagement with the cam pulley in order to allow rotation thereof and close the movable clamping jaw 22.

When the lifting clamp device 10 is located directly above the slab material to be lifted, a human operator will pull the device down toward the slab material whilst the hoop of actuating cable 110 is kept stationary. A downward directed pulling force exerted by an operator will causes the cam pulley to rotate, resulting in the movable jaw being displaced and moved into gripping position. The entire clamp device 10 is hereby lowered as the actuating cable 110 is unwound from the pulley. When stop cross bars provided below the cross bars 28 come into contact with the upper edge of the sheet material (the width of the slab material), the movable jaw 22 contacts the sheet and, together with the fixed jaw 20, grips the slab for lifting and transporting.

Once the slab material has been moved to its intended position, the lifting force is released form the cable 110 allowing the cam pulley 74, which advantageously is provided with a helical winding spring to induce rotation of the pulley in a direction counter the cable unwinding direction, to turn and partially wind cable 110 around pulley 74, thereby allowing the movable jaw 22 to return to the open/rest position under the influence of the biasing springs 80, 82. The lifting operation is repeated in the same manner.

As can be seen from the above discussion, the lifting force exerted upwardly on the upper portion of the cable 110 and the centre of gravity of the slab and the lifting device are substantially aligned vertically by inclining the movable jaw member at an angle with respect to the vertical. It has been found that an angle between 9 degrees to 11 degrees with respect to the vertical gives the best results in term of enhancing the stability of the device during lifting operation. The even distribution of the gripping force provided by the cam mechanism and the substantial alignment of the lifting force and the gravity force of the device and slab material being lifted of the improved lifting device result in the device being able to lift large and heavy slab material with less incident of breakage and/or deforming of the slab material, depending on whether the material is stone, marble or metal. Of course, modifications such as the profile of the cam surface of the cam members, the number and locations of the tension springs, the location of the pulleys, the size and cross-sectional shape of the cross bars, the material of various components of the lifting device to form a light weight yet strong enough to withstand the heavy duty performance, etc. are all within the scope contemplated by the disclosed invention.

The invention claimed is:

1. Clamping device suitable for lifting and handling of sheet-like objects, having a rigid frame with a fixed jaw that provides a first clamping surface, a movable jaw that provides a second clamping surface that is substantially parallel to the first clamping surface, the movable jaw being supported at the frame for reciprocating, linear movement towards and away from the fixed jaw, and an operating mechanism arranged to bias the movable jaw towards the fixed jaw in response to an actuating force being exerted on a tensile force transmitting member of the operating mechanism, to thereby abut the respective clamping surfaces onto opposite faces of the sheet-like object received between the jaws and frictionally clamping same against displacement, characterised in that the movable jaw comprises a sliding plate on which the second clamping surface is provided, the sliding plate being inclined at an angle of about 8 to 12 degrees with respect to the first and second clamping surfaces and being supported at the frame to maintain said angle during movement to and from the fixed jaw, and in that the tensile force transmitting member is guided and supported at an upper location of the sliding plate that substantially aligns with or overhangs the second clamping surface, wherein the operating mechanism is a cam pulley system of the type having an actuating pulley mounted on the sliding plate with an axis of rotation of the actuating pulley being perpendicular to the sliding plate, variable-height actuating cams protruding from one face of the pulley, and actuating rollers that are mounted in fixed locations on a stationary frame part opposite the movable sliding plate in such manner as to co-operate with a respectively associated one of the cams thereby to travel along the cams upon rotation of the pulley, wherein the arrangement is such that rotation of the pulley causes axial displacement of the sliding plate and the pulley along the axis of the rotation of the pulley.

2. Clamping device according to claim 1, wherein the tensile force transmitting member for rotating the pulley is an actuator cable that is secured to the pulley at its perimeter and partially wound on and running in a peripheral groove of the pulley.

3. Clamping device according to claim 2, wherein the rigid frame is an assembly comprising a side plate that provides the fixed jaw, a substantially rectangular parallelepiped shaped housing part with an open side disposed to face the side plate, and a plurality of cross struts rigidly joining the side plate and the housing part in spaced apart relationship at upper ends thereof.

4. Clamping device according to claim 3, wherein pedestals at a bottom wall or diametrically opposed side walls of the housing part provide the stationary frame part that supports and locates the actuating rollers engaging the cams of the pulley.

5. Clamping device according to claim 4, wherein the housing part has a cavity in which the cam pulley of the operating mechanism locates when the clamping device is in a fully open, non-clamping state in which the movable sliding plate comes to rest adjacent the housing part and covers the open side face of the housing part.

6. Clamping device according to claim 5, wherein the cam pulley system includes at least four support rollers or wheels mounted at respective axles and within respective receptacles formed equidistantly spaced apart in the pulley, the axle extending radially with respect to the axis of rotation of the pulley, the support rollers arranged to abut a back surface of the inclined sliding plate on which the pulley is received.

7. Clamping device according to claim 1 or 6, further including a locking mechanism that is arranged to lock the cam pulley system against rotation.

8. Clamping device according to claim 7, wherein the locking mechanism is arranged to be engageable only when the movable jaw is in its non-clamping position.

9. Clamping device according to claim 8, wherein the locking mechanism includes a rotatable locking member operably connected to a manual actuating member, the locking member being supported on the housing part in a location where it can be in moved into and out of engagement with a locking receptacle provided either on the cam pulley or a support shaft thereof.

10. Clamping device according to claim 9, wherein the manual actuating member includes a spring-loaded actuator rod attached to the outside of the housing part, the locking member comprising a latching plate fixed within the housing part cavity for rotation about an axis parallel to the rotation axis of the pulley, and an actuator arm extending through an opening in the housing part into engagement with the actuator rod, the cam pulley having a cut-out formed in its periphery into which the latching plate may be rotated into form-locking engagement.

11. Clamping device according to claim 10, wherein the sliding plate has mounted to it at an upper end thereof two sheaves or guide rollers in between which is guided in abutting engagement the tensile force transmitting member in centered relationship with respect to the operating axis of the cam pulley system.

12. Clamping device according to claim 11, wherein the sliding plate includes at an upper end thereof tubular guide members traversing the plate at about 8 to 12 degrees off-set to a perpendicular line to the plate plane, the guide members arranged to be received in sliding engagement on the cross-struts that join the side plate and the housing part.

13. Clamping device suitable for lifting and handling of sheet-like objects, having a rigid frame with a fixed jaw that provides a first clamping surface, a movable jaw that provides a second clamping surface that is substantially parallel to the first clamping surface, the movable jaw being supported at the frame for reciprocating, linear movement towards and away from the fixed jaw, and an operating mechanism arranged to bias the movable jaw towards the fixed jaw in response to an actuating force being exerted on a tensile force transmitting member of the operating mechanism, to thereby abut the respective clamping surfaces onto opposite faces of the sheet-like object received between the jaws and frictionally clamping same against displacement, characterised in that the movable jaw comprises a sliding plate on which the second clamping surface is provided, the sliding plate being inclined at an angle of about 8 to 12 degrees with respect to the first and second clamping surfaces and being supported at the frame to maintain said angle during movement to and from the fixed jaw, in that during movement to and from the fixed jaw the sliding plate translates without rotation relative to the fixed jaw, and in that the tensile force transmitting member is guided and supported at an upper location of the sliding plate that substantially aligns with or overhangs the second clamping surface, wherein the operating mechanism includes a drive pulley that is mounted on the sliding plate of the movable jaw with its axis of rotation perpendicular to the plane of the sliding plate, at least four bearing rollers are arranged to support the pulley in parallel relationship at the facing sliding plate surface, at least two actuating cams are provided on the pulley so as to protrude from the pulley surface that faces away from the sliding plate, the at least two actuating cams being disposed symmetrically and concentrically about the rotation axis of the pulley and extending along an arc sector radially inwards of the pulley circumference, the cams having a height that increases from near the pulley face to a maximum height that is related to the maximum spacing between the fixed and movable jaws of the clamping device in their fully spaced apart position, the cams each defining a sloped guide and bearing surface for respective actuator rollers that are secured in fixed relationship on a stationary part of the clamp frame that faces the pulley, the arrangement being such that upon rotation of the pulley, the actuator rollers travel along the guide and bearing surfaces of the cams thereby displacing the pulley and therewith the associated sliding plate along the axis of rotation of the pulley relative to the rigid frame.

14. Clamping device according to claim 13, wherein the inclination angle of the sliding plate is about 11 degrees.

15. Clamping device according to claim 13, wherein the height increase in the cams is uniform and progressively increasing or progressively decreasing along their extension.

16. Clamping device according to claim 13, wherein the contour of the bearing surfaces is rectilinear, curved or otherwise so shaped as to achieve during rotation of the pulley a desired displacement pattern of the sliding plate.

17. A device for lifting and handling sheet, panel and slab materials using a fixed jaw and a movable jaw for gripping the material to be lifted, comprising: a rigid frame having a first and a second side arranged in spaced apart and opposed relation to each other, with each side having an upper portion and a lower portion, at least two upper horizontal cross-bars and at least two lower cross-bars connecting the first and second sides to form the rigid frame, the lower portion of the first side extends downwardly and having an inner surface and an outer surface, the inner surface being vertical and substantially flat, the lower portion of the first side forming the fixed jaw, the lower portion of the second side extends downwardly and at an angle relative to vertical, a movable plate mounted on the at least two lower cross-bars for moving thereon toward and away from the fixed jaw, the movable plate is mounted having a lower portion which extends at an angle relative to vertical which is equal to the angle of the lower portion of the second side, a cam pulley mechanism for driving the movable plate along the at least two lower cross-bars, the cam pulley mechanism comprising a pulley mounted on the movable plate for rotation, two cam members mounted on one side of the pulley for rotating therewith, and a cable wound around a groove provided on the outer circumference of the pulley for rotating the pulley, the cam members each having a cam surface facing away from the one side of the pulley and engaging a respective roller of at least one pair of the diametrically opposed rollers such that, when the cable is pulled upwardly, the cable rotates the pulley as the cable unwinds from the pulley, the cam surfaces rotate and ride on the at least one pair of diametrically opposed rollers to drive the movable plate and the movable jaw toward the fixed jaw while the angle of the movable plate is maintained the same.

18. A device according to claim 17, wherein the pulley further comprising at least four rollers mounted radially inwardly of the groove of the pulley and in contact with a surface of the movable plate to reduce friction when the pulley rotates relative to the movable plate.

19. A device according to claim 17, wherein tension springs are provided to pull the movable plate toward the second side.

20. A device according to claim 17, wherein a locking device mounted to the second side and comprising a locking plate and handle for rotating the locking plate into engagement with a groove in a support shaft of the cam pulley mechanism to lock the cam pulley mechanism from displacing relative to the second side.

* * * * *